United States Patent [19]

Bellini

[11] Patent Number: 4,635,521

[45] Date of Patent: Jan. 13, 1987

[54] ELECTRONIC MUSICAL INSTRUMENT HAVING COVER WITH OPERATION PANEL

[75] Inventor: Mario Bellini, Milan, Italy

[73] Assignee: Nippon Gakki Seizo Kabushiki Kaisha, Hamamatsu, Japan

[21] Appl. No.: 684,931

[22] Filed: Dec. 20, 1984

[30] Foreign Application Priority Data

| | | | |
|---|---|---|---|
| Jan. 7, 1984 | [JP] | Japan | 59-9145[U] |
| Jan. 26, 1984 | [JP] | Japan | 59-8253[U] |
| Jan. 27, 1984 | [JP] | Japan | 59-9144[U] |
| Jan. 27, 1984 | [JP] | Japan | 59-9146[U] |
| Jan. 27, 1984 | [JP] | Japan | 59-9148[U] |

[51] Int. Cl.[4] ..... G10C 3/02

[52] U.S. Cl. ..... 84/177; 84/180; 84/DIG. 3; 84/DIG. 17

[58] Field of Search ..... 84/176–180, 84/DIG. 3, DIG. 17; 361/334, 340, 428, 395

[56] References Cited

U.S. PATENT DOCUMENTS

| | | | |
|---|---|---|---|
| 1,020,914 | 3/1912 | Knabe, Jr. | 84/178 |
| 2,105,739 | 1/1938 | Jacobs et al. | 84/180 |
| 4,334,453 | 6/1982 | Kumano | 84/177 |
| 4,380,947 | 4/1983 | Nishimoto | 84/176 |

FOREIGN PATENT DOCUMENTS

| | | | |
|---|---|---|---|
| 4614 | of 1912 | United Kingdom | 84/180 |
| 478746 | 1/1938 | United Kingdom | 84/178 |

OTHER PUBLICATIONS

Japanese Design Registration No. 548447.

Japanese Patent Laid Open Specification No. Sho5-7-20791.

Japanese Utility Model Laid Open Specification No. Sho57-11578.

Japanese Utility Model Laid Open Specification No. Sho 57-23588.

*Primary Examiner*—L. T. Hix

*Assistant Examiner*—Brian W. Brown

*Attorney, Agent, or Firm*—Blakely, Sokoloff, Taylor & Zafman

[57] ABSTRACT

An electronic musical instrument has a pivotal cover which mounts an operation panel for controlling the functions of the instrument. Cords for connecting a main electric circuit incorporated in a musical instrument main body and control switches and elements in the operation panel are arranged through a hollow shaft constituting a pivot structure of the cover so that the connecting cords are not exposed to outside of the instrument. A foldable music sheet stand may be provided at an open end of the cover opposite to its pivot structure. When the cover is opened, the music stand can be extracted to stand up above the operation panel.

21 Claims, 13 Drawing Figures

ELECTRONIC MUSICAL INSTRUMENT HAVING COVER WITH OPERATION PANEL

BACKGROUND OF THE INVENTION

The present invention relates to an electronic musical instrument having a cover with an operation panel.

Various types of electronic keyboard instruments such as compact electronic organs, keyboards and music synthesizers generally have an operation panel with various operation switches. When the operation panel having a main electric circuit is incorporated in the main body of the electronic keyboard instrument, no wiring problem occurs. However, when the operation panel is incorporated in the cover which can be freely opened with respect to the main body, wiring between the cover and the main body must be considered. For example, an electric circuit incorporated in the main body is connected to various types of operation switches arranged in the cover through external wiring. In this case, the cord holes must be formed in the main body and the cover. When excessively large holes are formed, the cords are externally visible, resulting in poor appearance. However, when excessively small holes are formed, the cords are flexed when the cover is opened or closed. This may lead to incomplete electrical connections or to disconnections.

On the other hand, connectors may be mounted in the main body and the cover. In this case, cables each having plugs or receptacles at two ends are connected to the connectors in the main body and in the cover when the electronic keyboard instrument is used. However, the cable connections are required every time the electronic keyboard instrument is used, resulting in cumbersome operation.

The operation panel incorporated in the cover is generally arranged on the upper main body panel behind the keyboard or on the inner surface of the cover. When the operation panel is arranged in the cover, a very limited space is formed between various switches of the operation panel and the main body when the cover is closed, thus limiting design concepts. In addition, an electronic musical instrument of slim construction cannot be prepared. The switches cannot be arranged in the vicinity of a pivot portion of the cover (in order to prevent the switches from contact with the main body when the cover is closed), thus disabling effective utilization of the entire area of the operation panel.

In a conventional electronic keyboard instrument of this type, a special music stand is not used, and an operation panel surface of a cover serves as the stand for a music sheet. However, a player cannot operate the instrument controls since they are covered by the music sheet, thus disabling desired musical performance. In order to solve this problem, the player memorizes the music that he is going to play, or plays the music while the corresponding music sheet is set at a side of the operation panel. Although a music stand is provided in a main body as described in U.S. Pat. No. 4,380,947 or Japanese Patent Disclosure No. 57-20791, a storage space of the music stand is increased and the operability of the control switches behind the music sheet held on the stand is not improved.

SUMMARY OF THE INVENTION

It is, therefore, a principal object of the present invention to provide an electronic musical instrument having a cover with an operation panel, wherein a cable for connecting an electric circuit incorporated in a musical instrument body and a sub electric circuit incorporated in an operation panel of a cover is not externally observed to provide an electronic musical instrument of good appearance, and undesirable electrical connections and electrical disconnections are eliminated.

In order to achieve the above object, the cover is hinged to the instrument body, a through hole is formed in a connecting shaft constituting a hinge assembly, and a cable for connecting the electric circuit in the instrument body and the operation switches in the operation panel of the cover is inserted through the through hole.

It is another object of the present invention to provide an electronic musical instrument having a cover with an operation panel, wherein the area of the operation panel in which the operation switches are disposed is increased as compared with that of the conventional operation panel.

In order to achieve the above object, a recess is formed in the instrument body, some of the operation switches are arranged in a vicinity of the base portion of the cover which serves as a pivot portion, and those switches are accommodated in the recess when the cover is closed.

It is still another object of the present invention to provide an electronic musical instrument with a music stand, wherein the music stand can be easily housed in a small space with a simple structure and a music sheet on the stand does not hinder the operation of switches on an operation panel.

In order to achieve the above object, a foldable music stand is housed in a front end face of the cover of the instrument.

BRIEF DESCRIPTION OF THE DRAWINGS

FIG. 7(*c*) is a sectional side view of the music stand along the line VII—VII of FIG. 7(*a*);

DESCRIPTION OF THE PREFERRED EMBODIMENTS

Figure 1:
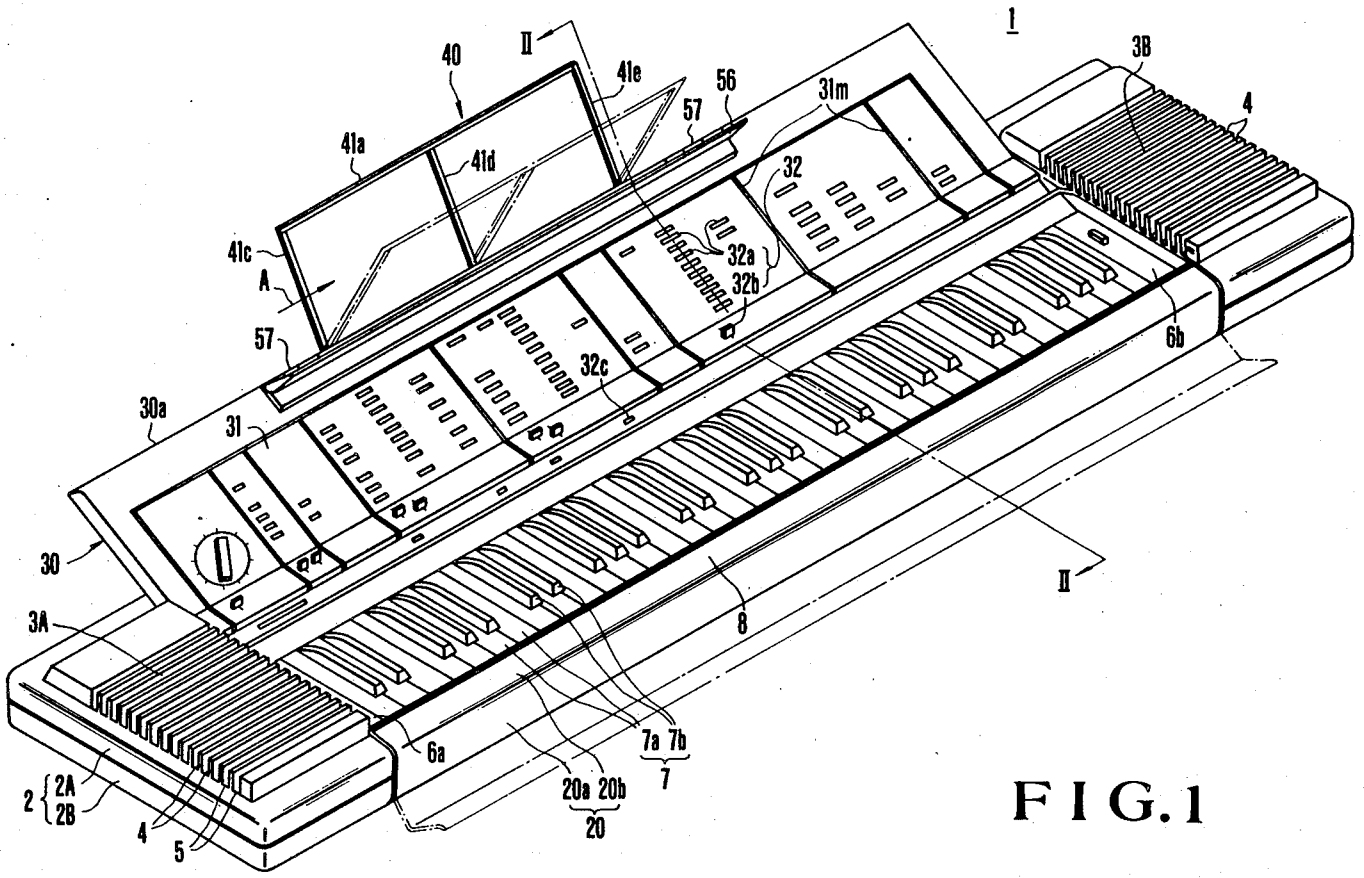
FIG. 1 is a perspective view showing an outer appearance of an electronic musical instrument having a cover with an operation panel according to an embodiment of the present invention when the cover is opened.

FIGS. 1 to 4 show an electronic musical instrument having a single keyboard and a cover with an operation panel according to embodiment of the present invention. Referring to FIGS. 1 to 4, reference numeral 1 denotes a musical instrument main body 2 having an upper case 2A and a lower case 2B which constitute a shallow box extending along the right-and-left direction. A front cover 20 and a cover 30 having a flat outer surface are arranged on the main body 2. The front cover 20, the cover 30 and the main body 2 constitute a shallow box-like musical instrument housing.

Two end portions of the main body 2 constitute speaker housings 3A and 3B. The upper surface of each of the speaker housings 3A and 3B is constituted by a plurality of fins 4 and a plurality of speaker slits 5. The front half of the upper surface and the front end face of the main body 2 extend horizontally between the speaker housings 3A and 3B. A keyboard portion 8 comprises a pair of left and right end blocks **6*a* and 6*b*, and a keyboard 7 consisting of a plurality of natural and sharp keys 7*a* and 7*b***.

Figure 2:
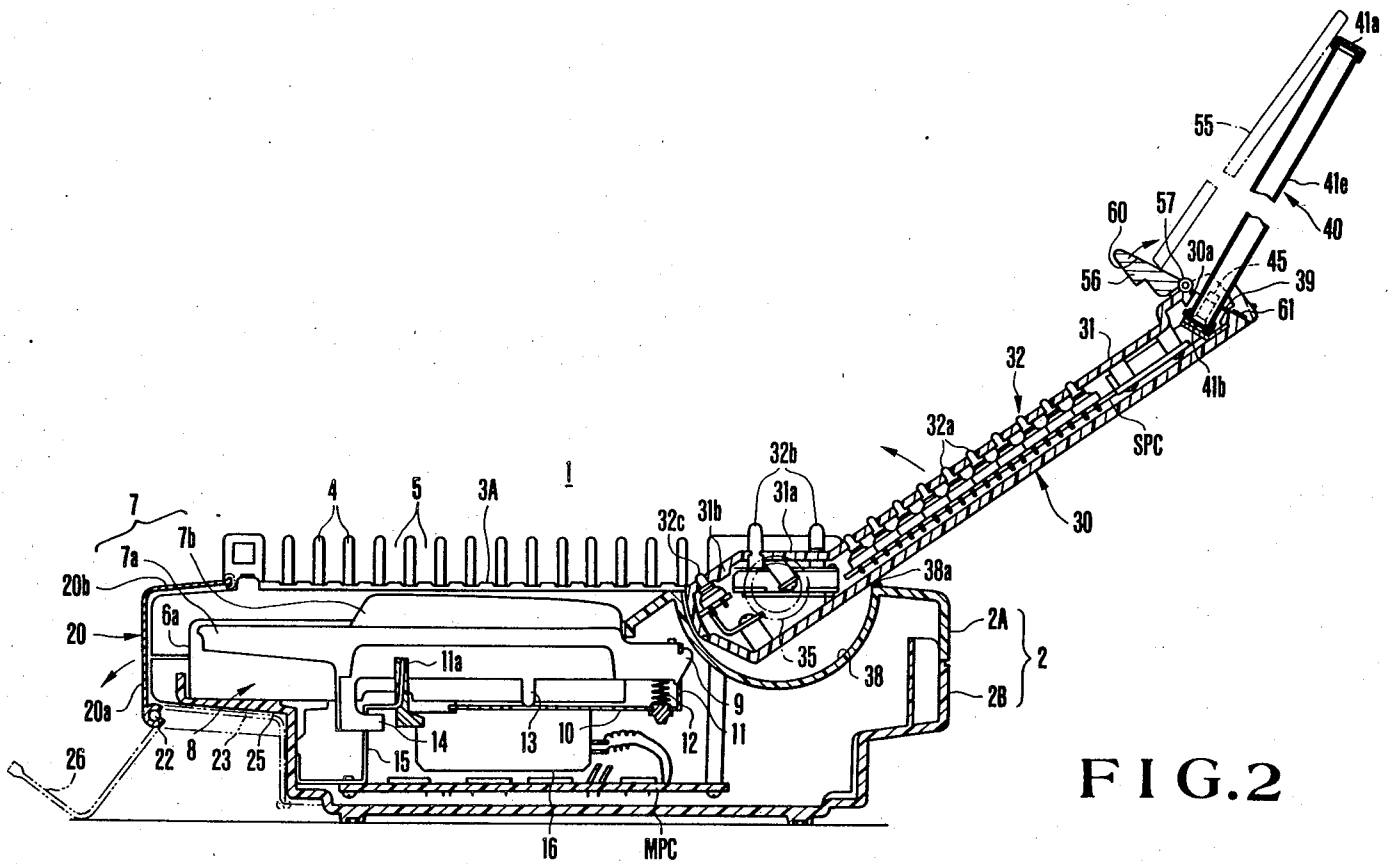
FIG. 2 is an enlarged sectional view of the instrument along the line II—II of FIG. 1.

Each natural key **7*a* (and each sharp key 7*b*) is vertically pivoted about an engaging portion between a projection 9 integrally extending on a rear end face and a hole 11 in a keyboard frame 10, as shown in FIG. 2. At the same time, each natural key 7*a* is constantly biased clockwise by a spring 12 arranged between the lower surface of the key and the frame 10. Furthermore, each natural key 7*a* integrally has an actuator 13 extending downward from its lower surface and an L-shaped stopper 14. The distal end of the stopper 14 is inserted in a hole 15 formed in the keyboard frame 10 to limit the upward movement of the key. As a result, each natural key 7*a* is kept substantially horizontal while it can be pivoted through a small angle. When a player strikes the key, the key is pivoted downward (counterclockwise in FIG. 2) against the biasing force of the spring 12. The actuator 13 energizes a key switch 16 arranged on the lower surface of the keyboard frame 10. An electrical signal is supplied from this key switch 16 to a main electric circuit on a printed circuit board MPC disposed below the switch 16. As a result, a musical tone corresponding to the key 7*a* is electrically generated. It should be noted that reference numeral 11*a*** denotes a lower limit stopper of the key and is covered with an elastic material.

The front cover 20 is arranged to freely open/close the front end face of the keyboard portion 8 and has substantially an inverted L-shaped construction constituted by a vertical portion **20*a* and a horizontal portion 20*b*. The front cover 20 is pivoted about a shaft 22 mounted at the lower end thereof so as to cover/expose the front end face excluding the speaker housings 3A and 3B. Therefore, when the electronic keyboard instrument is carried, the front cover 20 is closed as indicated by a solid line in FIG. 2 so as to cover the front surface and front end face of the end blocks 6*a* and 6*b* and the natural keys 7*a*. At the same time, the front cover 20 holds a front end of the cover 30 when the cover 30 is closed. However, during a musical performance, the front cover 20 is pivoted counterclockwise through approximately 270° about the shaft 22. The front cover 20 is stored along a lower surface 25 of a front edge of the lower case, as indicated by an alternate long and short dashed line 23 in FIG. 2. In this case, when the front cover 20 is pivoted as indicated by an alternate long and two short dashed line 26 in FIG. 2**, the front cover can be used as a shelf for a pencil and an eraser and the like on its L-shaped inner surface when a music piece is being composed.

Figure 3:
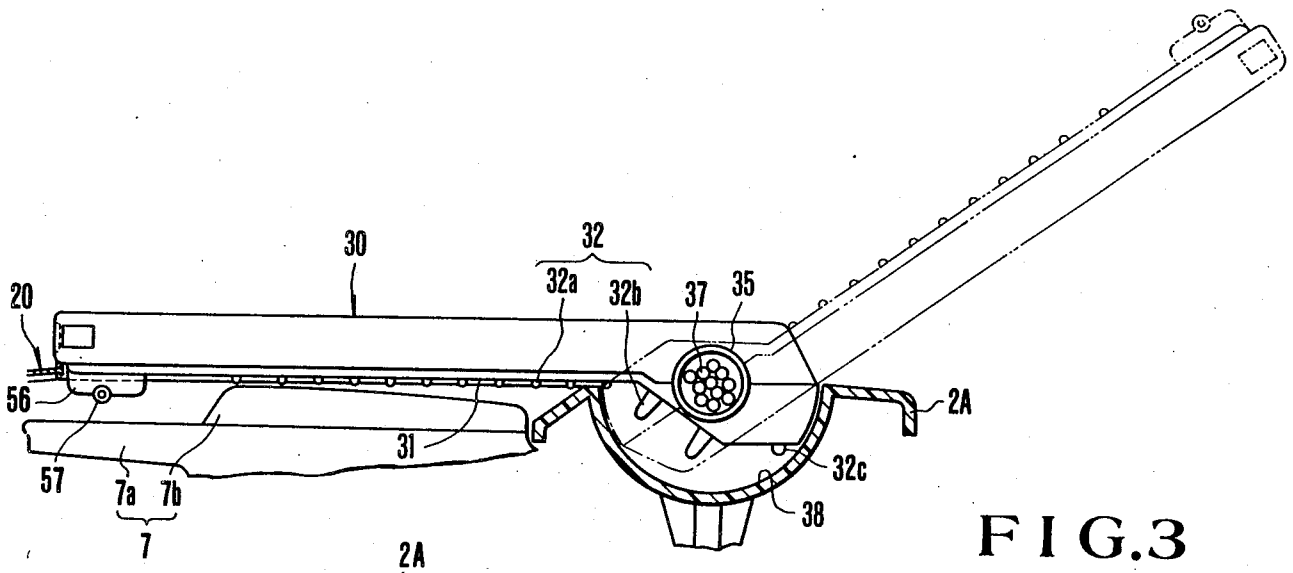
FIG. 3 is a sectional side view showing the main part of the instrument when the cover is closed.

The cover 30 comprises a hollow plate structure and can be opened/closed vertically with respect to the rear end portion of the upper surface of the main body 2. The rear end portion (corresponding to the lower end when the cover 30 is opened) is inserted in a semicircular recess 38 formed in the rear end of the upper surface of the upper case 2A. Shafts 35 are provided on both side ends of the cover 30 and are pivotally supported in bearing holes 2H (FIG. 4) formed in the right and left side walls of the recess 38. During musical performance, the cover 30 is opened until the lower end or proximal portion of the cover 30 abuts against a pivot stopper **38*a* (FIG. 2) of the upper edge of the rear portion of the recess 38, so that an operation panel 31 arranged on the inner side of the cover 30 is held at a proper angle so as to optimize operation of the various switches and reading of the music sheet. When the cover 30 is closed, the front end of the cover 30 abuts against the front cover 20 to cover the keyboard portion 8, as shown in FIG. 3**.

The operation panel 31 extends over substantially the entire area of the inner surface of the cover 30. The operation panel 31 has operating elements 32 such as tone selection switches **32*a* for selecting one of organ, harpsichord, piano and other tone colors, tone volume resistors 32*b* and rhythm selection switches. In this embodiment, partition marks 31*m* are formed to group the operating elements so as to enable easy recognition of the different operating elements. The rear end portion i.e., pivot portion of the cover 30 has a semicircular section, as shown in FIG. 2. This pivot portion comprises a thick surface 31*a* which becomes substantially flat when the cover 30 is opened. The tone volume resistors 32*b* having relatively large operating elements are arranged in the surface 31*a*. A surface 31*b* is continuous with the surface 31*a* and is formed at a side (keyboard direction) opposite to the main surface of the operation panel 31. The surface 31*b* is substantially parallel to the main surface of the operation panel 31. Operating elements 32*c* such as keyboard split switches and a fill-in switch are arranged in the surface 31*b*. Furthermore, the inner surface or the operation surface of the cover 30 is located on a line passing through a pivot portion (center of the shaft 35) or outside the pivot portion, thereby obtaining the thin and compact cover 30 and the shaft 35** of a large diameter.

Figure 4:
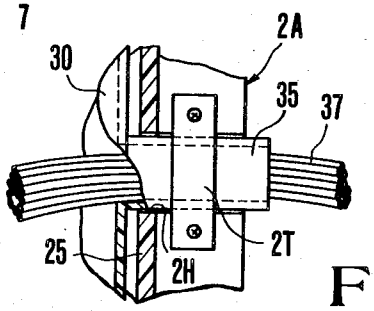
FIG. 4 is a perspective view showing a mounting state of cords.

A printed circuit board SPC having various switch circuits printed thereon is incorporated in the cover 30. The operating elements 32 mounted on the operation panel 31 are connected to the printed circuit board SPC. The printed circuit board SPC and the printed circuit board MPC are electrically connected through cords 37. The hollow shaft 35 pivotally supporting the cover 30 has a relatively large diameter, as shown in FIGS. 3 and 4. The various cords 37 including the cords for connecting the printed circuit board SPC and the printed circuit board MPC in the main body 2 are inserted in the hollow shaft 35 and extend through the hollow shaft 35 into the main body 2A. Referring to FIG. 4, the shaft 35 is inserted in the holes 2H formed in the two end walls 25 along the length of the recess formed in the upper case 2A. The shaft 35 is pivotally fastened by fastening metal pieces 2T. With this arrangement, the connecting cords are not exposed to the outside of the instrument and a special hole for the cords need not be formed in the cover 30. The cords 37 will not be vertically moved when the cover 30 is opened/closed, thereby preventing incomplete electrical connections and electrical disconnections.

Figure 5:
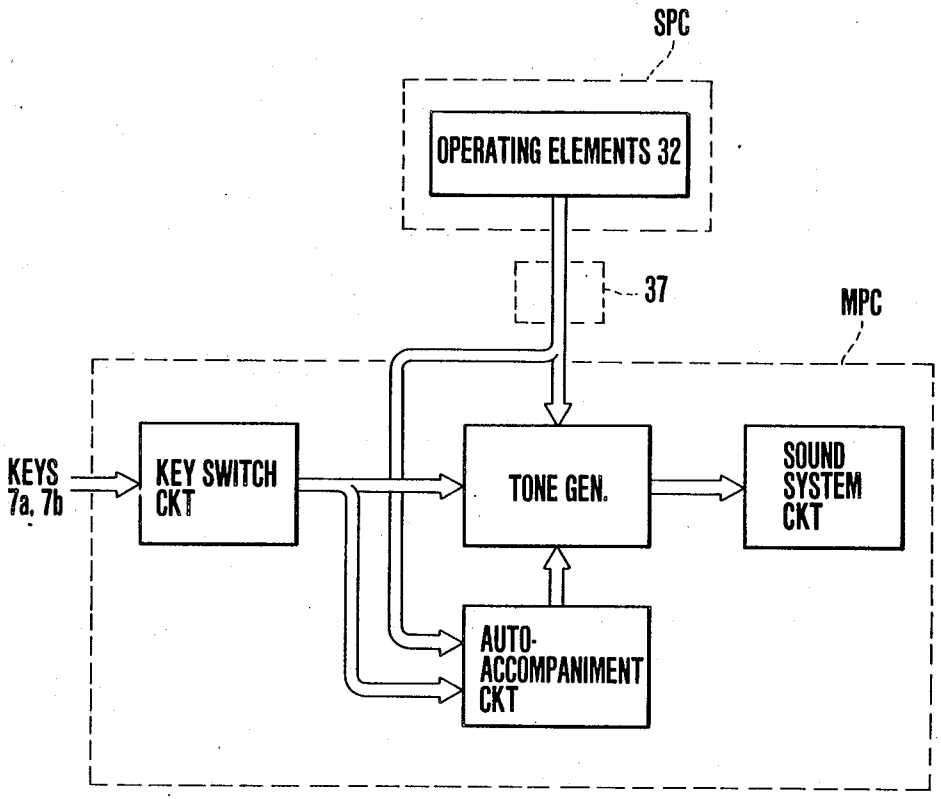
FIG. 5 is a block diagram showing the basic arrangement of an electric circuit of the electronic musical instrument.

A circuit used in the electronic musical instrument described above is known to those skilled in the art, and a detailed description thereof will be omitted. Such a circuit has a basic arrangement shown in FIG. 5. The main printed circuit board MPC incorporated in the main body 2 has: a keyswitch circuit for generating key information upon depression of one or more of the natural and sharp keys 7*a* and 7*b* in the keyboard 2; a tone generator for producing a musical tone in accordance with the key information and operation of the operating elements 32 such as the tone selector switch 32*a* and the tone volume resistors 32*b*; an auto-accompaniment circuit for performing automatic musical accompaniment; and a sound system circuit. In this case, signals are exchanged through the cords 37 between the sub printed circuit board SPC and the main printed circuit board MPC. The circuit arrangement is not limited to the above. For example, the tone generator, the auto-accompaniment circuit and even the sound system circuit may be located within the cover 30.

Figure 6:
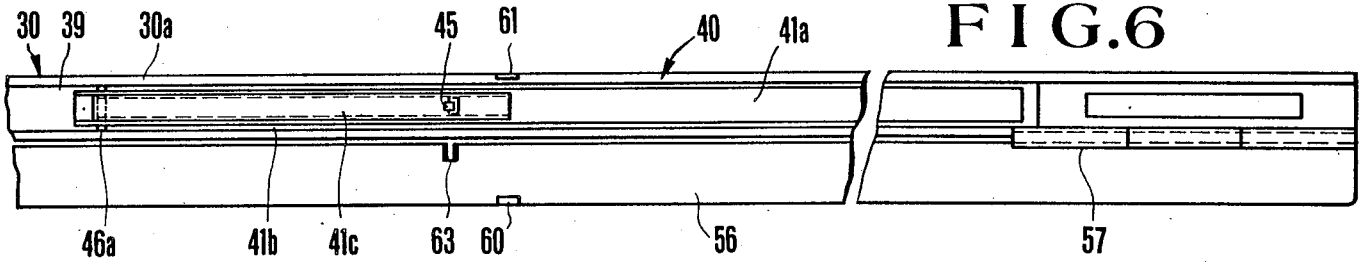
FIG. 6 is a plan view showing a music stand when the music stand is folded and housed in a recess.
Figure 7A:
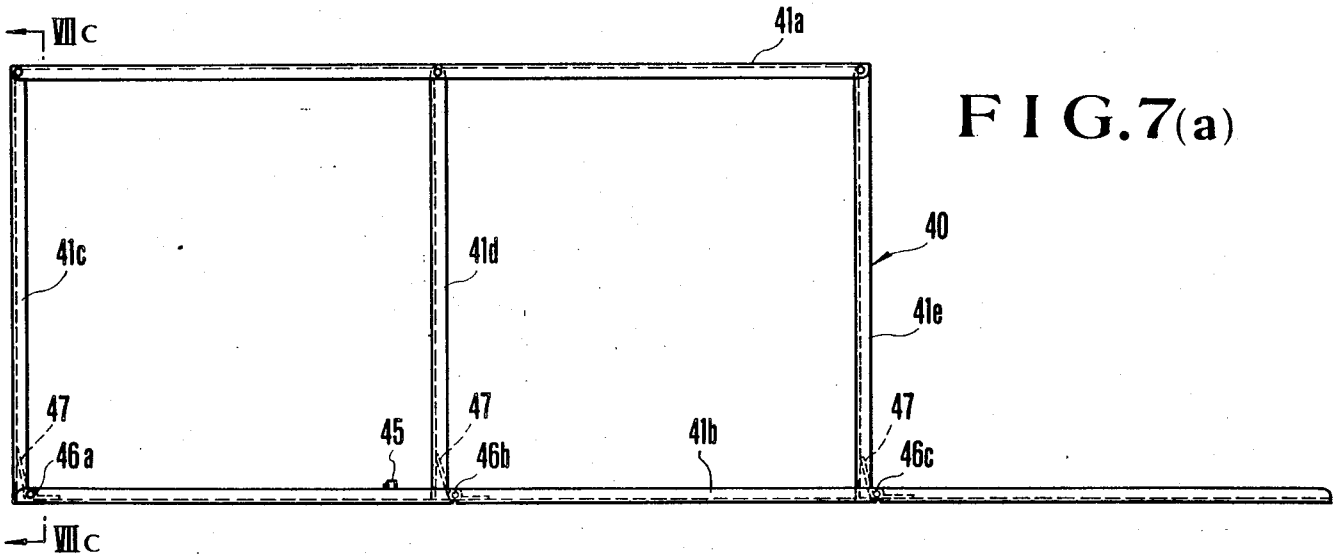
FIGS. 7(*a*) and 7(*b*) are front views of the music stand when it is expanded and folded, respectively.
Figure 7B:
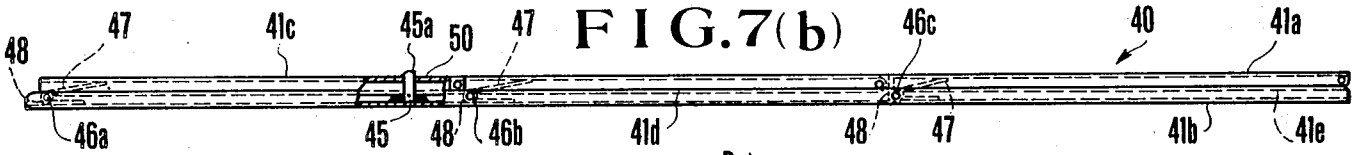
Figure 7C:
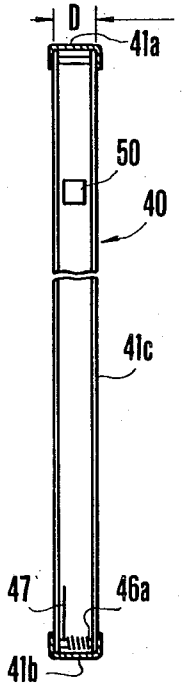

A music stand 40 can be folded and can be housed in a recess 39 formed in the front end face 30*a* of the cover 30. The music stand 40 will be described in detail with reference to FIGS. 2, 6 and FIGS. 7(*a*) to 7(*c*). The music stand 40 is made of a metal plate having a substantially U shape cross-section. The music stand 40 comprises upper and lower horizontal members 41*a* and 41*b*, and three vertical members 41*c*, 41*d* and 41*e* which have the same length. The upper and lower ends of the vertical members 41*c*, 41*d* and 41*e* are pivotally coupled by pins to the upper and lower horizontal members 41*a* and 41*b* at equal intervals. The upper horizontal member 41*a* has a length twice (or more) that of the vertical member 41*c* (41*d* or 41*e*). The upper ends of the vertical members 41*c*, 41*e* and 41*d* are pivotally coupled to two ends and the center of the upper horizontal member 41*a*, respectively. The lower horizontal member 41*b* has a length three times (or more) that of the vertical members 41*c*, 41*d* and 41*e*. The lower ends of the vertical members 41*c*, 41*d* and 41*e* are respectively pivotally coupled at the left end, one-third from left end, and two-thirds from left end positions through connecting pins 46*a*, 46*b* and 46*c*, respectively. The lower horizontal member 41*b* is fixed at the inner bottom surface of the recess 39. The vertical members 41*c*, 41*d* and 41*e* are biased counterclockwise in FIG. 7(*a*) by torsion coil springs 47 mounted on the connecting pins 46*a*, 46*b* and 46*c*, respectively. In other words, the vertical members 41*c*, 41*d* and 41*e* are biased to stand up. In this case, pin mounting portions 48 (FIG. 7(*b*)) are integrally mounted on the right side surfaces of the lower ends of the vertical members 41*c*, 41*d* and 41*e*, respectively. When the vertical members 41*c*, 41*d* and 41*e* stand up, the lower surfaces of the pin mounting portions 48 and the lower end surfaces of the vertical members 41*c*, 41*d* and 41*e* abut against the upper surface of the lower horizontal member 41*b*. Therefore, the vertical members 41*c*, 41*d* and 41*e* will not lay down toward the left direction and can be kept substantially perpendicular to the upper surface of the lower horizontal member 41*b*. A depth D of each of the vertical members 41*c*, 41*d* and 41*e* is substantially equal to or less than the inner width of the upper horizontal member 41*a* (and the lower horizontal member 41*b*) as shown in FIG. 7(*c*). Therefore, the vertical members 41*c*, 41*d* and 41*e* can lay down against the biasing force of the torsion coil springs 47. When the music stand 40 is folded, the vertical members 41*c*, 41*d* and 41*e* are stored in the upper horizontal member 41*a*, as shown in FIG. 7(*b*). When the upper horizontal member 41*a* is overlapped on the lower horizontal member 41*b*, a resultant assembly is stored in the recess 39. In this case, the upper horizontal member 41*a* is housed in the recess 39 while being translated in the right direction. The music stand 40 (including the upper horizontal member 41*a* and the lower horizontal member 41*b*) occupies the same plane in the standing and folded states. In the folded state, the music stand 40 is locked by a lock member 45.

The lock member 45 is disposed within the inner bottom surface of the lower horizontal member 41*b* at a position corresponding to the vertical member 41*c*. The upper end of the lock member 45 comprises an L-shaped hook portion 45*a*. The hook portion 45*a* is engaged with an engaging hole 50 formed in the vertical member 41*c*, thereby preventing standing movement of the member 41*c*. In this case, the lock member 45 is made of a rigid material and can be pivoted. The lock member 45 is biased by a spring (not shown) in a direction (counterclockwise in FIG. 7(*b*)) such that the lock member 45 is engaged with the engaging hole 50.

The music stand 40 is more standing up than the cover 30 as seen in FIG. 2, so that the player can easily read a music sheet 55. A music stand cover/music sheet support 56 is provided on the inner edge of the front end face 30*a* of the cover 30 and can be pivoted through a hinge 57. The music sheet 55 stands on the support 56 and against the music stand 40 in the standing state. When the music stand 40 is housed, the recess 39 is covered with the support 56. An engaging recess 60 is formed at the center (along the longitudinal direction of the support 56) of the front edge of the inner surface of the support 56. An engaging projection 61 is formed on the front end face 30*a* of the cover 30 and can be engaged with the engaging recess 60. A recess 63 is formed in the inner surface of the support 56 at a position corresponding to the lock member 45 to clear the member 45 when the cover/support 56 covers the folded music stand 40.

In the electronic musical instrument having the arrangement described above, the music stand 40 is provided on the front end face 30*a* of the cover 30, and the music sheet 55 can be stably positioned. The music stand 40 occupies the same plane in the standing and folded states, so that the space of the recess 39 can be decreased, thereby obtaining a compact single keyboard instrument.

Unlike the case with a conventional musical instrument, the music sheet 55 will not cover the operation panel 31, so that the player can enjoy unimpeded performance. Furthermore, since the music stand 40 can be folded and housed in the recess 39 formed in the front end face 30*a*, the compact musical instrument can be easily carried.

Furthermore, the recess 39 is covered with the music stand support 56 so that the stored music stand cannot be exposed. When the music stand is not used, the cover front end face maintains a good appearance.

Figure 8:
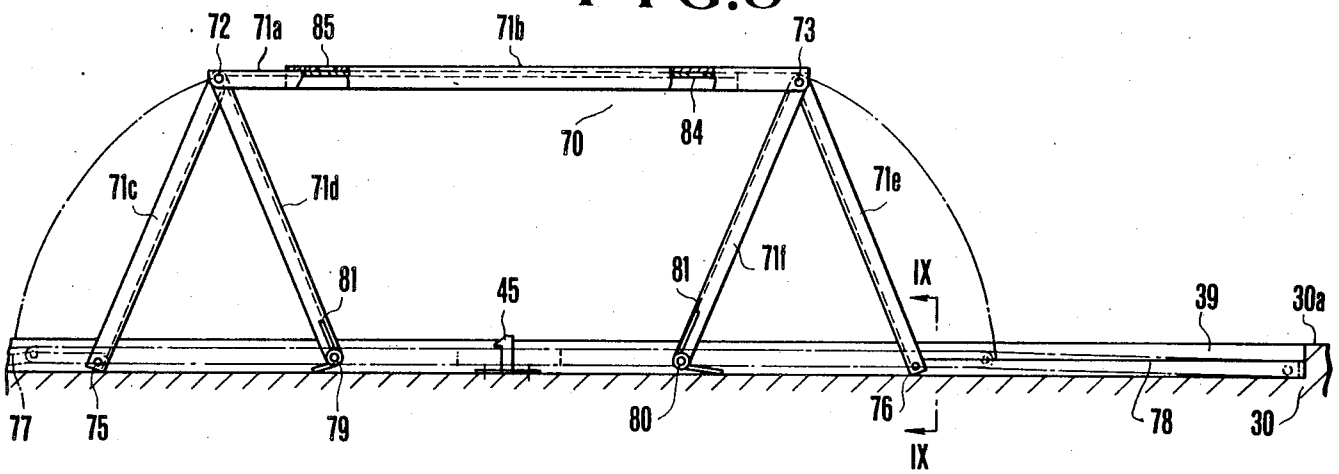
FIGS. 8 and 9 are respectively a front view and a side sectional view of a music stand of an electronic musical instrument according to a second embodiment of the present invention.
Figure 9:
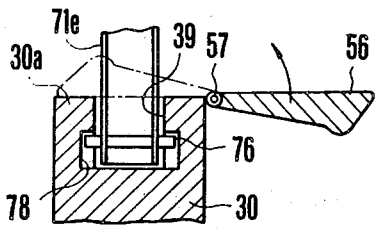

FIGS. 8 and 9 show a second embodiment of the present invention. The same reference numerals as in FIGS. 1 to 7 denote the same parts as in the above-mentioned first embodiment, and a detailed description thereof will be omitted. Referring to FIGS. 8 and 9, a music stand 70 comprises a pair of horizontal members 71*a* and 71*b* which can be telescoped together or extended in line with each other, and four inclined members 71*c*, 71*d*, 71*e* and 71*f*. The inclined members 71*c* and 71*d*, and, 71*e* and 71*f* constitute left and right pairs. The upper ends of the left pair of inclined members 71*c* and 71*d* are coupled by a common pin 72 at the left end of the horizontal member 71*a*, and the upper ends of the right pair of inclined members 71*e* and 71*f* are coupled by a common pin 73 at the right end of the horizontal member 71*b*. The lower ends of the outer inclined members 71*c* and 71*e* of the four inclined members 71*c* to 71*f* are movably inserted in a recess 39, and at the same time, pins 75 and 76 formed on the lower ends of the inclined members 71*c* and 71*e* are inserted in guide grooves 77 and 78, respectively, thereby preventing the inclined members 71*c* and 71*e* from being removed out of the recess 39. On the other hand, the inner inclined members 71*d* and 71*f* are pivotally mounted by the fixed pins 79 and 80 and are biased by torsion coil springs 81 mounted on the pins 79 and 80 clockwise and counterclockwise, respectively. The music stand 70 is thus kept in an upright position. When the music stand 70 is upright, the pins 75 and 76 abut against the right and left ends of the guide grooves 77 and 78 to prevent the music stand 70 from being moved toward the fixed pins 79 and 80. In this manner, the music stand 70 can be stably erected. When the music stand 70 is folded, a lock member 45 for locking the music stand is located at an intermediate portion between the fixed pins 79 and 80, and engaging holes 84 and 85 are formed in the pair of horizontal members 71*a* and 71*b* to be symmetrical about the lock member 45. When the engaging holes 84 and 85 overlap each other as the vertical members 71*c* to 71*f* are pushed down to fold the music stand 70, the overlapping engaging holes 84 and 85 are hooked by the lock member 45. When the music stand 70 is folded and is housed in the recess 39, the horizontal members 71*a* and 71*b* are fitted on the outer surfaces of the inner inclined members 71*d* and 71*f*. On the other hand, the outer inclined members 71*c* and 71*e* are held along the bottom surface of the recess 39 since the pins 75 and 76 are moved along the guide grooves 77 and 78 in the left and right directions, respectively.

It will be readily understood that the music stand 70 occupies the same plane in the standing and folded states.

Figure 10:
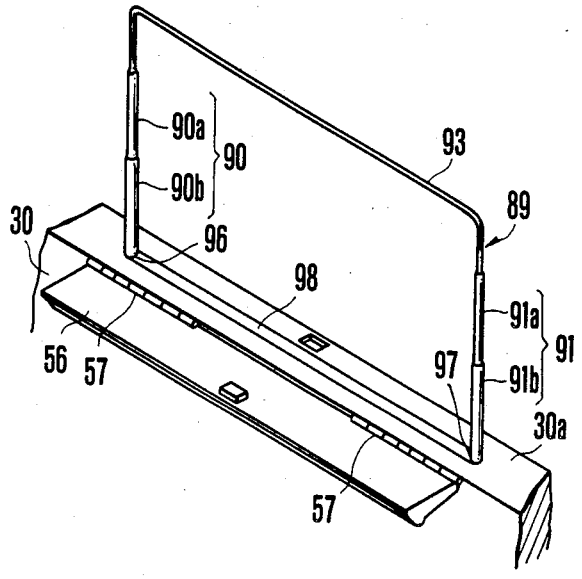
FIG. 10 is a perspective view showing a music stand and its peripheral components in an electronic musical instrument according to a third embodiment of the present invention.

FIG. 10 shows a third embodiment of the present invention. A music stand 89 comprises a pair of left and right legs 90 and 91 which can be telescopically extended/withdrawn and a substantially U-shaped bar 93 coupled to the upper ends of the legs 90 and 91. The legs 90 and 91 comprise two pipes 90*a* and 90*b* which have different diameters and two pipes 91*a* and 91*b* which are constructed in the same manner as the pipes 90*a* and 90*b*. The pipe 90*a* is slidably fitted in the pipe 90*b*, and the pipe 91*a* is slidably fitted in the pipe 91*b*. The lower pipes 90*b* and 91*b* are slidably inserted with a relatively large friction force in holes 96 and 97 formed in a front end face 30*a* of the cover 30. However, the lower pipes 90*b* and 91*b* are not removed from the holes 96 and 97, respectively. A groove 98 is formed in the front end face 30*a* and extends from the hole 96 to the hole 97. When the music stand 89 is folded, the horizontal portion of the bar 93 is held in the groove 98.

Figure 11:
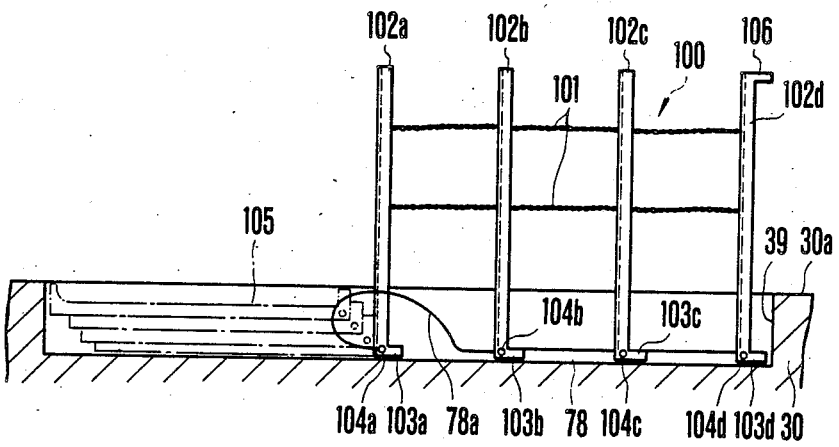
FIG. 11 is a front view showing a music stand and its peripheral components in an electronic musical instrument according to a fourth embodiment of the present invention.

FIG. 11 shows a fourth embodiment of the present invention. A music stand 100 comprises four columns 102*a* to 102*d* which are connected by connecting members 101 such as chains or strings. The lower ends of the columns 102*a* to 102*d* comprise: bent portions 103*a* to 103*d* which have a proper length and are bent in a direction perpendicular to the longitudinal direction of the columns 102*a* to 102*d*; and pins 104*a* to 104*d*, respectively. The leftmost column 102*a* can be pivoted with respect to the cover 30 in the right-to-left direction and will not be moved along the direction perpendicular to the longitudinal direction of the column 102*a*. The remaining three columns 102*b*, 102*c* and 102*d* are pivoted and moved along the guide groove 78 in the right-to-left direction. The guide groove 78 for guiding the pins 104*b*, 104*c* and 104*d* of the columns 102*b*, 102*c* and 102*d* has an enlarged portion 78*a* enlarged upward at the pin 104*a* of the column 102*a*, thereby easily moving the pins 104*b*, 104*c* and 104*d* when the music stand 100 is folded. As indicated by an alternate long and short dashed line 105, the columns 102*a* to 102*d* overlap each other and are held together in the recess 39. When the music stand 100 is to be pulled upward from the recess 39, the player holds a projection 106 extending at the distal end of the column 102*d* and pulls it upward while the columns 102*d* to 102*b* are being slid, thereby sequentially standing the columns 102*c*, 102*b* and 102*a* as indicated by the solid lines in FIG. 11.

The present invention is not limited to the particular embodiments described above. Various changes and modifications may be made within the spirit and scope of the invention. For example, in the second embodiment, the fixed pins 79 and 80 may be movable pins, and the pins 75 and 76 may be stationary pins, respectively. In the fourth embodiment, the movement of the rightmost column 102*d* in the left direction can be prevented by a proper lock means when the music stand 100 is erected.

According to the present invention, the hollow rotating shafts are disposed at the lower side ends of the cover. However, hollow stationary shafts may be mounted in the recesses at the two ends of the main body. The holes formed at the base portion of the cover may receive the stationary shafts, respectively.

What is claimed is:

1. An electronic musical instrument having a cover with an operation panel, comprising:

a music instrument body having a keyboard portion and an electric circuit for generating musical tones; and a cover pivotally mounted through a pivot structure on said instrument body so as to cover said keyboard portion when said cover is closed, said cover being provided with an operation panel having operating elements required for controlling the electric circuit;

said pivot structure comprising hollow shaft means mounted on one of said cover and said instrument body and bearing means formed in the other thereof to support said shaft means, and cord means inserted in said hollow shaft so as to electrically connect said electric circuit incorporated in said instrument body and said operating elements incorporated in said cover.

2. A musical instrument according to claim 1, wherein a rear end portion of an upper surface of said instrument body has a recess, extending along a longitudinal direction of said instrument body, for receiving a base portion of said cover.

3. A musical instrument according to claim 2, wherein said pivot structure is arranged at each of two ends of said recess.

4. A musical instrument according to claim 3, wherein said hollow shaft means is mounted on said cover, and side wall portions at two ends of said recess of said instrument body form said bearing means to be engaged with said hollow shaft means.

5. A musical instrument according to claim 2, wherein a rear edge of said recess has a pivot stopper to limit a pivotal movement of said cover.

6. A musical instrument according to claim 1, wherein said instrument body incorporates speaker housings at both sides thereof to mount speakers.

7. A musical instrument according to claim 1, wherein said keyboard portion is arranged at a front portion of said instrument body and extends along a longitudinal direction of said instrument body, said keyboard portion being covered by said cover and a front cover for covering a front end of said keyboard portion, said front cover being mounted at a lower end of the front portion of said instrument body to be pivoted with respect to said instrument body.

8. A musical instrument according to claim 1, wherein said cover has a flat outer surface and a thick base portion which is thicker than any other portion thereof, said pivot structure is arranged at said base portion, and a recess is formed in a rear portion of an upper surface of said instrument body to receive said base portion, at least one of said operating elements being accommodated in said recess when said cover is closed.

9. A musical instrument according to claim 8, wherein an inner surface of said cover which constitutes said operation panel comprises: a first surface constituting a main part of said operation panel; a second surface continuous with said main part and formed in said base portion, said second surface being substantially horizontal when said cover is opened; and a third surface continuous with said second surface, formed in said base portion, and substantially parallel to said first surface.

10. An electronic musical instrument comprising: a musical instrument body having a recess and a keyboard portion; and a cover having a pivot portion insert in said recess, said cover being arranged to cover said keyboard portion of said instrument body when said cover is closed, said cover having an inner surface provided with a plurality of operating elements so as to constitute an operation panel, some of said operating elements which are located in a vicinity of said pivot portion being received in said recess when said cover is closed.

11. A musical instrument according to claim 1, wherein a foldable music stand is arranged at recess formed in a front end face of said cover.

12. A musical instrument according to claim 11, wherein a foldable music stand is arranged to be held in a storage portion formed in said cover, is stood on a bottom surface of said storage portion, and occupies an identical plane in folded and standing states.

13. A musical instrument according to claim 11, wherein said music stand is held in a storage portion formed in said front end face in the folded state by a lock member which locks the music stand in the folded state.

14. A musical instrument according to claim 11, wherein said music stand comprises:

upper and lower horizontal members parallel to each other;

first, second and third vertical members which have the same length, upper ends of which are respectively pivotally coupled to a left end, a central position and a right end of said upper horizontal member, and lower ends of which are respectively pivotally coupled to a left end, a one-third from the left end, and two-thirds from the left end of said lower horizontal member;

springs mounted on the lower ends of said vertical members for biasing said first, second and third vertical members in a direction to keep said music stand standing;

a lock member mounted at a predetermined position on said lower horizontal member; and an engaging portion formed on said upper horizontal member at a position corresponding to the predetermined position when said music stand is folded, whereby said music stand is held in said recess by said lock member which locks said engaging portion when said music stand is folded.

15. A musical instrument according to claim 11, wherein said music stand comprises:

first and second horizontal members which are coupled to be telescoped/withdrawn from each other;

first and second vertical members which constitute a vertical member pair and upper ends of which are pivotally coupled to one end of said first horizontal member, said first vertical member having a lower end which is slidably moved through a first movable pin fitted in the recess in the front end face of said cover, said second vertical member having a lower end which is pivotally fixed by a first stationary pin;

third and fourth vertical members which constitute another vertical member pair and upper ends of which are pivotally coupled to one end of said second horizontal member, said third vertical member having a lower end which is slidably moved through a second movable pin fitted in the recess in the front end face of said cover, said fourth vertical member having a lower end which is pivotally fixed by a second stationary pin;

springs mounted on said first and second stationary pins so as to bias said second and fourth vertical members in opposing directions;

a lock member mounted on said second horizontal member; and engaging portions which are formed in said first and second horizontal members and which are commonly engaged with said lock member at a corresponding position when said music stand is folded, whereby said music stand is kept stood by a biasing force of said torsion springs in a standing state and is held in the recess by said lock member and said engaging portions in a folded state.

16. A musical instrument according to claim 11, wherein said music stand comprises:

a horizontal bar having L-shaped portions at two ends thereof, said L-shaped portions having vertical portions, respectively;

a pair of first and second vertical pipes, said first vertical pipe being slidably fitted in said second vertical pipe, one of said vertical portions being slidably fitted in said first vertical pipe, said second vertical pipe being slidably fitted in a first opening formed at one end of the recess of the front end face of said cover; and a pair of third and fourth vertical pipes, said third vertical pipe being slidably fitted in said fourth vertical pipe, the other of said vertical portions being slidably fitted in said third vertical pipe, said fourth vertical pipe being slidably fitted in a second opening formed at the other end of the recess of the front end face of said cover, whereby said music stand is fitted in the recess when said music stand is stored.

17. A musical instrument according to claim 11, wherein said music stand comprises:

a first L-shaped vertical column which has a first horizontal portion at a lower end thereof so as to allow said first vertical column to keep standing and which is pivotally fixed to said cover;

second and third L-shaped vertical columns which respectively have second and third horizontal portions at lower ends thereof so as to allow said second and third vertical columns to keep standing and which are pivotally supported by movable pins to be slidable along the recess of the front end face of said cover;

a fourth U-shaped vertical column which has fourth and fifth horizontal portions at upper and lower ends thereof and which is pivotally supported by a movable pin to be slidable along the recess of the front end face of said cover, said fourth horizontal portion being used as a projection to allow a player to pull up said fourth vertical column from the recess, said fifth horizontal portion being used to keep said fourth vertical column standing; and horizontal connecting members for connecting said first to fourth vertical columns.

18. A musical instrument according to claim 11, wherein said musical instrument comprises a music stand to be held in a storage portion formed in a front end of said cover and a music sheet support mounted on said cover at a position corresponding to said storage portion, said music sheet support being arranged to be swingable so as to cover said storage portion when said music stand is stored.

19. A musical instrument according to claim 18, wherein said music sheet support is coupled to said cover through a hinge.

20. A musical instrument according to claim 11, wherein an angle of elevation of said music stand is larger than that of said operation panel when the music stand is unfolded and the cover is opened.

21. A musical instrument according to claim 1, wherein said operation panel is divided into groups by means of partition marks.

* * * * *